US011274259B2

(12) United States Patent
Woodmansee, Jr.

(10) Patent No.: US 11,274,259 B2
(45) **Date of Patent: *Mar. 15, 2022**

(54) FUEL INCLUDING POLY-OXYGENATED ALUMINUM HYDROXIDE

(71) Applicant: HEMOTEK LLC, Plano, TX (US)

(72) Inventor: John W. Woodmansee, Jr., Frisco, TX (US)

(73) Assignee: HEMOTEK, LLC, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/191,394

(22) Filed: Mar. 3, 2021

(65) Prior Publication Data

US 2021/0189269 A1 Jun. 24, 2021

Related U.S. Application Data

(63) Continuation of application No. 16/505,208, filed on Jul. 8, 2019, now Pat. No. 10,941,363, which is a continuation of application No. 16/259,426, filed on Jan. 28, 2019, now Pat. No. 10,344,234.

(60) Provisional application No. 62/632,126, filed on Feb. 19, 2018.

(51) Int. Cl.
*C10L 1/12* (2006.01)

(52) U.S. Cl.
CPC ..... *C10L 1/1233* (2013.01); *C10L 2200/0218* (2013.01); *C10L 2200/0254* (2013.01); *C10L 2200/0423* (2013.01); *C10L 2200/0446* (2013.01); *C10L 2250/06* (2013.01); *C10L 2270/02* (2013.01)

(58) Field of Classification Search
CPC ..... C10L 1/1233; C10L 2250/06; C10L 2200/0218; C10L 2200/0254; C10L 2270/02; C10L 2200/0446; C10L 2200/0423; C10L 2200/0407; C10L 2230/04

See application file for complete search history.

(56) References Cited

U.S. PATENT DOCUMENTS

| | | | | |
|---|---|---|---|---|
| 10,344,234 | B1 * | 7/2019 | Woodmansee, Jr. | C10L 1/1233 |
| 10,941,363 | B2 * | 3/2021 | Woodmansee, Jr. | C10L 1/1233 |
| 11,130,901 | B2 * | 9/2021 | Parini | C09K 8/52 |
| 2017/0281544 | A1 * | 10/2017 | Woodmansee, Jr | C01F 7/02 |
| 2017/0304357 | A1 * | 10/2017 | Woodmansee, Jr | A61K 9/0019 |
| 2018/0271899 | A1 * | 9/2018 | Woodmansee, Jr | A61K 9/0026 |
| 2019/0038665 | A1 * | 2/2019 | Woodmansee | A61K 9/1682 |
| 2019/0298759 | A1 * | 10/2019 | Woodmansee | B82Y 5/00 |
| 2020/0002598 | A1 * | 1/2020 | Parini | C10G 75/04 |

* cited by examiner

*Primary Examiner* — Ellen M McAvoy
(74) *Attorney, Agent, or Firm* — Culhane Meadows PLLC; Robert Klinger

(57) ABSTRACT

A composition including poly-oxygenated metal hydroxide material that comprises a clathrate containing oxygen gas ($O_2$) molecules free of chlorine and a fuel, The poly-oxygenated metal hydroxide material, such as OX66™ material, is added to a fuel, such as, but not limited to, fuels such as petrol, alcohol and diesel, which are combustible in engines to create significantly increased horsepower and torque. The OX66™ material is added to fuel in different ratios to generate improved performance. The different ratios are based on several Tractors including the type and design of the engine, the type of fuel, and environmental parameters.

16 Claims, 5 Drawing Sheets

FUEL INCLUDING POLY-OXYGENATED ALUMINUM HYDROXIDE

CLAIM OF PRIORITY

This application is a continuation of U.S. Ser. No. 16/505,208 flied Jul. 8, 2019 entitled FILTER INCLUDING POLY-OXYGENATED ALUMINUM HYDROXIDE FOR REMOVING NOX, issued as U.S. Pat. No. 10,941,363, which is a continuation of U.S. Ser. No. 16/259,426 filed Jan. 28, 2019 entitled FUEL INCLUDING POLY-OXYGENATED METAL HYDROXIDE, issued as U.S. Pat. No. 10,344,234.

FIELD OF THE DISCLOSURE

The present invention is directed to a filter for an effluent gas.

BACKGROUND

A poly-oxygenated metal hydroxide material that comprises a clathrate containing oxygen gas ($O_2$) molecules is marketed as OX66™ and is manufactured by and available from Hemotek LLC of Piano, Tex. The OX66™ material is soluble and has the unique properties of holding oxygen gas ($O_2$) molecules in the clathrate, which oxygen gas molecules are freely released when added toother materials including fluids. The OX66™ material is a white powder and is also refined to as a powder in this disclosure.

An internal combustion engine (ICE) is a heat engine where the combustion of a fuel occurs with an oxidizer (usually air) in a combustion chamber that is an integral part of the working fluid flow circuit. In an internal combustion engine, the expansion of the high-temperature and high-pressure gases produced by combustion applies direct force to some component of the engine. The force is applied typically to pistons, turbine blades, rotor or a nozzle. This force moves the component over a distance, transforming chemical energy into useful mechanical energy.

The term internal combustion engine usually refers to an engine in which combustion is intemittent, such as the more familiar four-stroke and two-stroke piston engines, along with variants, such as the six-stroke piston engine and the Wankel rotary engine. A second class of internal combustion engines use continuous combustion: gas turbines, jet engines and most rocket engines, each of which are internal combustion engines on the same principle as previously described. Firearms are also a form of internal combustion engine.

In contrast, in external combustion engines, such as steam or Stirling engines, energy is delivered to a working fluid not consisting of, mixed with, or contaminated by combustion products. Working fluids can be air, hot water, pressurized water or even liquid sodium, heated in a boiler, ICEs are usually powered by energy-dense fuels such as gasoline or diesel, liquids derived from fossil fuels. While there are many stationary applications, most ICEs are used in mobile applications and are the dominant power supply for vehicles such as cars, aircraft, and boats.

Typically an ICE is fed with fbssii fuels like natural gas or petroleum products such as gasoline, diesel fuel or fuel oil. There is a growing usage of renewable fuels like biodiesel for CI (compression ignition) engines and bioethanol or methanol for SI (spark ignition) engines. Hydrogen is sometimes used, and can be obtained from either fossil fuels or renewable energy.

Engines typically exhaust NOx in an effluent gas. The NOx is harmful to people and the environment.

SUMMARY

A composition including poly-oxygenated metal hydroxide material that comprises a clathrate containing oxygen gas ($O_2$) molecules free of chlorine and a fuel. The poly-oxygenated metal hydroxide material, such as OX66™ material, is added to a fuel, such as, but not limited to, fuels such as petrol, alcohol and diesel, which are combustible in engines to create significantly increased horsepower and torque. The OX66™ material is added to fuel in different ratios to generate improved performance. The different ratios are based on several factors including the type and design of the engine, the type of fuel, and environmental parameters.

DETAILED DESCRIPTION

The OX66™ material typically has the configuration of a white powder and is also referred to as a powder in this document. The OX66™ material is a poly-oxygenated aluminum hydroxide comprising a clathrate that contains oxygen gas molecules ($O_2$). The OX66™ material is patented and described in U.S. patents and patent applications, including U.S. Pat. No. 9,801,906 B2 and U.S. Pat. No. 9,980,909 B2, the teachings of which are incorporated herein by reference. As described in U.S. Pat. No. 9,980,909, the OX66™ material is soluble, and may be chlorine free. The surface area of the OX66™ material is immense due to the shape of each of the particles of the material. This immense surface area creates an absorption of surrounding materials, such as oxygen, water, and so forth which is a muhiPlier of any oxygen gas content inherent in the material.

Applicant has discovered a new and advantageous use of the OX66™ material when combined/mixed with a fuel, such as, but not limited to, petrol, alcohol and diesel. The freely releasable oxygen gas molecules $O_2$ of the clathrate significantly increase the energy released when combusting the fuel. Only a small portion of the OX66™ material is needed to significantly increase the energy created, such as to increase both horsepower and torque of an internal combustion engine. For instance, the mix ratio by volume of fuel to OX66™ material can be about 100:1, or less, such as 200:1.

In testing prior to trying a fuel including the OX66™ material in a vehicle engine, it was discovered that a quantity of the OX66™ material solubilized with liquid fuels, including gasoline, alcohol, and diesel etc. With large amounts of the OX66™ material mixed with the fuel, the absorption or suspension of the powder seemed to reach a point where no obvious reaction was noticed, and the result was the powder and fuel mixture turned into a gelatinous sludge. In test tubes, at lower volumetric combinations it was discovered there appeared to be an optimum point where the powder and the fuel interacted quite actively, producing a gaseous reaction bubbling the fuel almost like carbonated water. It was discovered that there is a defined range where the mixture of the fuel and the powder is optimum for the absorptive and oxygenating effects of the powder. It was discovered that there is visual evidence of reaction at approximately 100 to 1 fuel to powder volumetrically. One important discovery is that there is a point where too much powder results in an excessive residue or gelatinous sludge. As the amount of powder is reduced, that is, as the ratio is increased, the resulting compound seems to achieve an optimum saturation where the maximum fuel is released. The OX66™ material is soluble in a fluid, and it was discovered that the material is also soluble in the fuel. Precise measurement of oxygen gas quantities and the cross between the solids and the liquid components are only approximations of volume.

Figure 1:
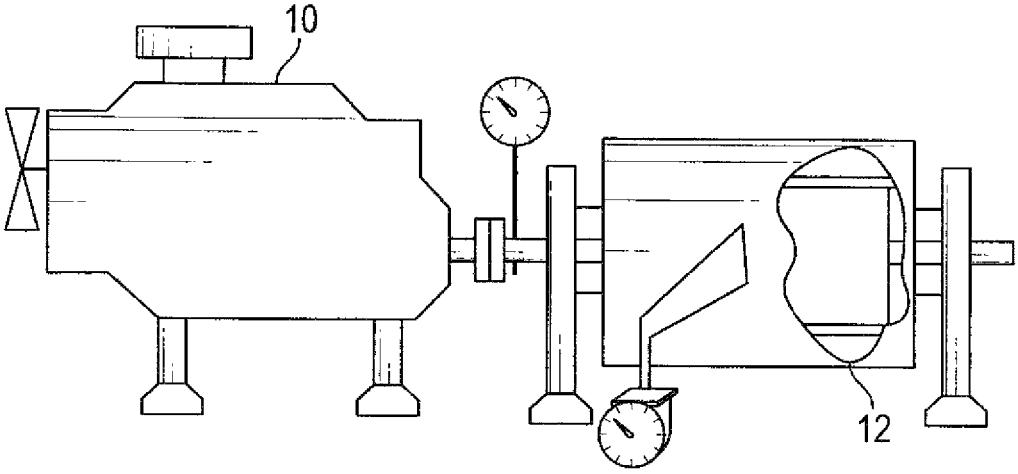
FIG. 1 illustrates a typical combustion engine combusting fuel including the OX66™ material according to a method and system of the disclosure.

For vehicular engine testing, extremely small quantities of the powder compared to the fuel was used, about a 100 to 1 mixture by volume, or about a thimble full of powder per gallon of 91 Octane gasoline. The powder was solubilized in the fuel. A 1933 Ford engine 10 was connected to a dynamometer 12, as illustrated in FIG. 1, and the 100 to 1 mix ratio by volume of the 91 Octane gasoline to powder was combusted by the engine. One initial discovery was the leaning out the filet air mixture with the powder material. Without the means to measure or analyze the resulting compound and mixture components we continued dynamometer testing of mixture, tuning the engine carburetor by adjusting the air fuel mixture.

Figure 2:
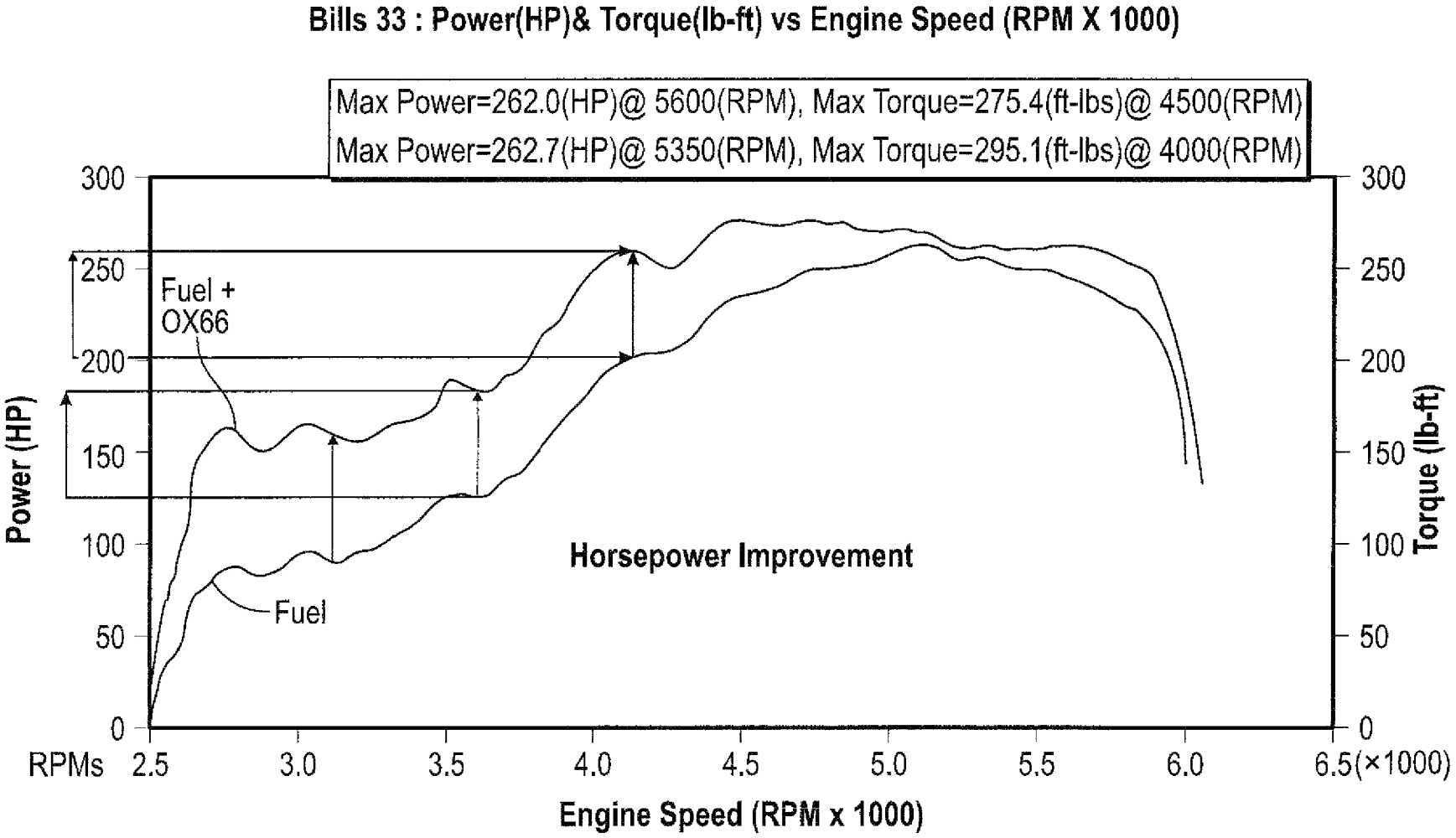
FIG. 2 illustrates an improvement in horsepower, and movement of the AFR between the two dyno runs.
Figure 3:
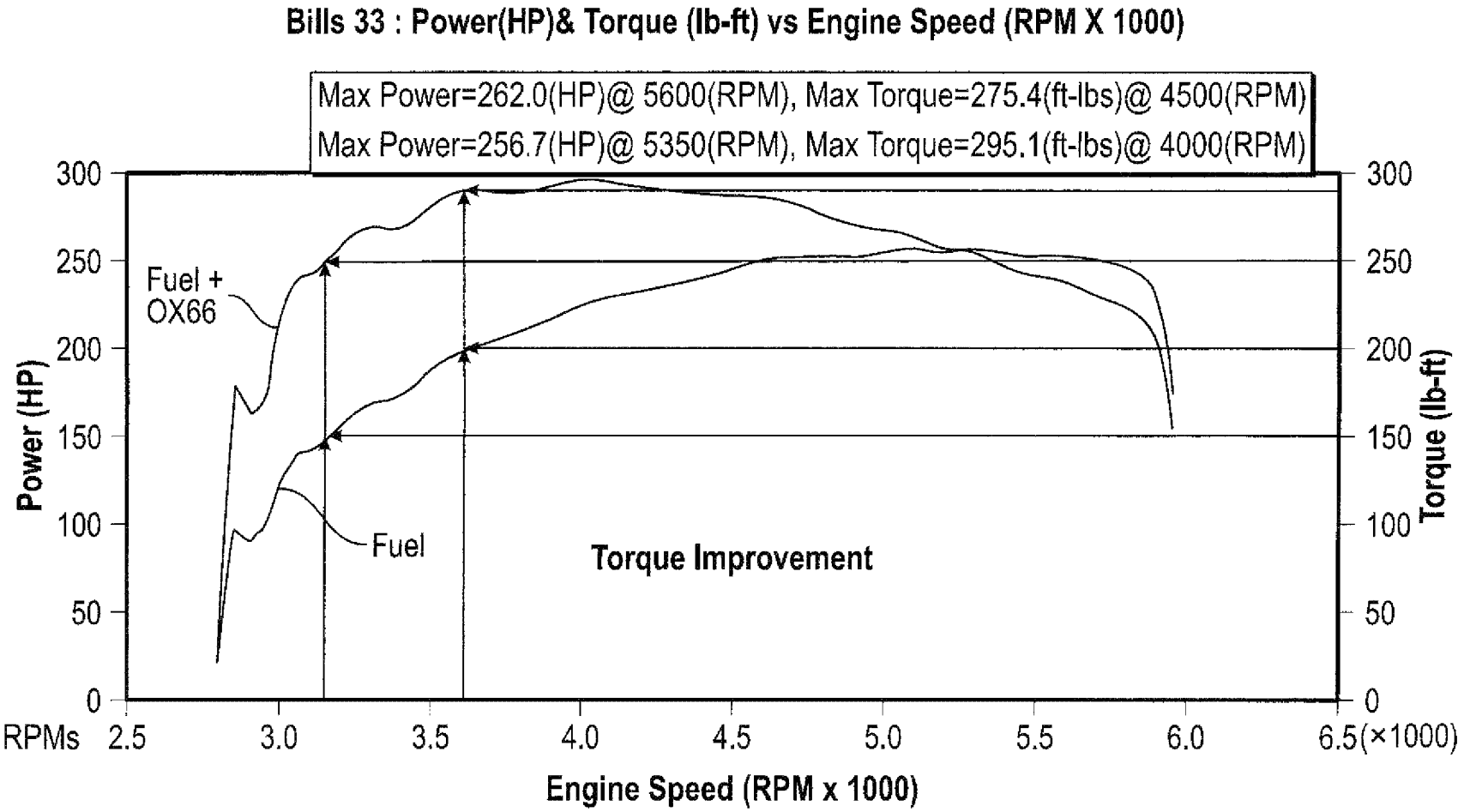
FIG. 3 illustrates an improvement in torque, and movement of the AFR between the two dyne runs.

The charts shown in FIGS. 2-3 show an increase of approximately 1.9 units from a very rich air fuel ratio (AFR) mixture of 10 to a leaner mixture of 11.9 over the course of the testing. FIGS. 2-3 represent runs at the beginning and end to illustrate the changes in engine 10 performance measured through the testing at an approximately 100 to 1 mixture. FIGS. 2-3 clearly indicate significant improvement in horsepower, torque, particularly at the lower rpm end but also throughout the entire rpm range, and movement of the AFR between the two dyno runs.

There are differing methods for delivering the powder to the fuel, such as a meth spray kit with water or meth mixed with the powder.

As shown in FIG. 2, the engine horsepower (hp) significantly increases compared to using the same fuel without the OX66™ material. As illustrated, at 3200 rpms, the engine horsepower is increased from about 90 hp to 160 hp when burning the fact including the powder. This is an increase of 70 hp, about 77%. At about 3600 rpms, the horsepower increases from about 125 hp to 180 hp when burning the fuel including the powder, an increase of about 44%, At about 4150 rpms, the horsepower increases from about 200 hp to 260 hp, an increase of about 30%. As illustrated in FIG. 2, the increase of horsepower using fuel including the OX66™ material is significant, particularly from engine speeds of 0 to 5000 rpm. Notably, the horsepower is increased over the entire range of rpm using the fuel including the powder as compared to using fuel only.

As shown in FIG. 3, which corresponds to the same testing of FIG. 2, the engine torque significantly increases when burning the fuel including the powder as compared burning fuel without the OX66™ material. As illustrated, at 3200 rpms, the engine torque is increased from about 150 ft-lbs to 240 ft-lbs when burning the fuel including the powder, as compared to burning the fuel without using the powder, an increase of about 60%, which is huge. At 3600 rpms, the engine torque is increased from about 200 ft-lbs to 290 11-lbs, an increase of about 45%. The torque generated when combusting the fuel with and without the OX66™ material is about even at about 4800 rpms. As illustrated in FIG. 3, the increase of engine torque using fuel including the OX66™ material is significant, particularly from engine speeds of 0 to 4300 rpm.

In some applications, the particle size of the OX66™ material can be limited in size, and/or homogenous. For instance, the particle sizes can all be less than a particular limit, such as under 200 microns, 100 microns, and 50 microns. This sizing can help increase solubility in the fuel, and also to avoid creating a residue or clogging certain components or passageways in a device, such as an engine.

The ratio of the fuel to powder can be higher than 100:1, such as 200:1 or greater. The ratio can be less than 100:1, such as 80:1, but the sludge factor becomes an issue. The ratio can depend on many factors such as the desired increase in power vs. the cost, and the affect of the powder on a particular engine.

Embodiment 2

Nitrogen liberated in the presence of not fully combusted oxygen creates a number of nitrogen-oxygen effluents that are generally referred to as "NOx" gases.

Nitrogen dioxide and nitric oxide are referred to together as oxides of nitrogen (NOx). NOx eases react to form smog and acid rain as well as being central to the formation of fine particles (PM) and ground level ozone, both of which are associated with adverse health effects.

The effluent gas is particularly pervasive in diesel engines, gas turbines, power plant boilers, and process furnaces. However, it is also true that if the gasoline fueled internal combustion engine has an alier-burner to destroy the pollutants CO and hydrocarbms, this combined system necessarily uses excess air and heat and as a consequence of the additional heat to the effluent, NOx gases are produced.

Figure 4:
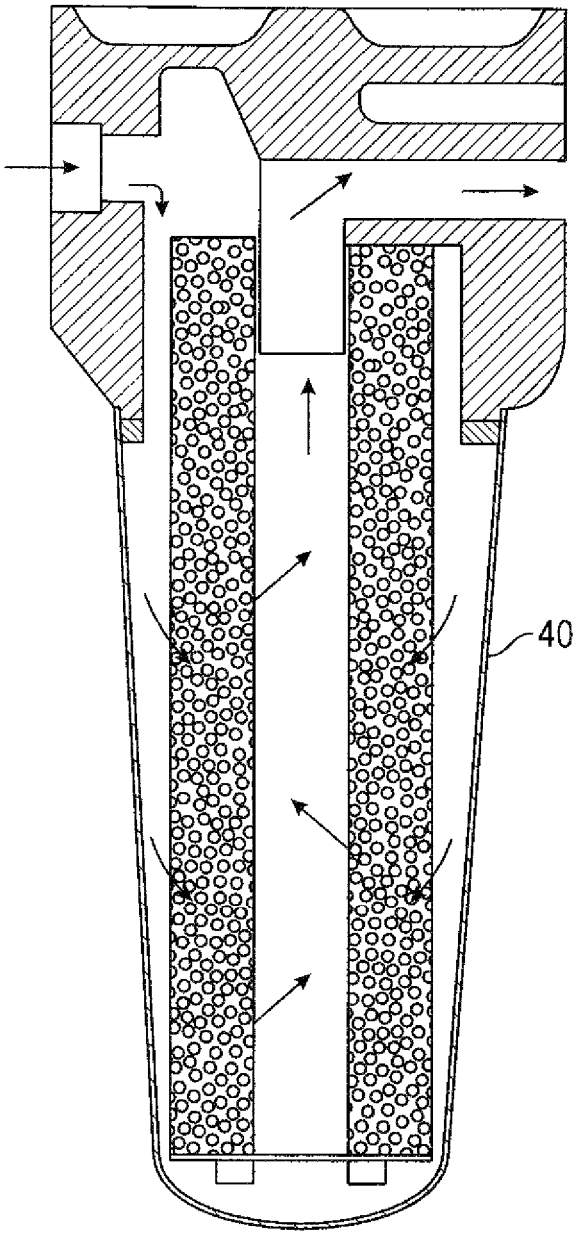
FIG. 4 illustrates a filter whereby gas or excess effluent is passed through a poly oxygenated metal hydroxide comprising a clathrate such that the NOx is attached to the clathrate and held in stasis.

According to this disclosure, one process for removing the NOx from the effluent gas stream is as follows. The gas or excess effluent is passed through a poly-oxygenated metal hydroxide comprising a clathrate, such that the NOx is attached to the clathrate and held in stasis such as shown at 40 in FIG. 4. The NOx is held in stasis across a wide range of temperatures to over 1200 degrees centigrade since the clathrate liberates small amounts of water at 100 C and it remains soluble and reactive at over 1200 degrees C. The poly-oxygenated metal hydroxide may comprise a poly-oxygenated aluminum hydroxide, such as OX66™ manufactured by Hernotek LLC of Plano, Tex. This type of filtration system can require cleaning when the extraction media (the OX66™) gets spent or contaminated to a less than desirable saturation point.

Figure 5:
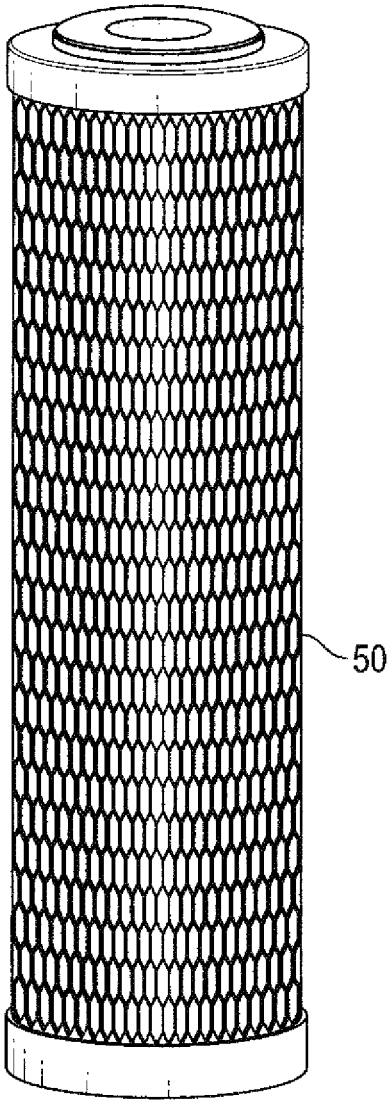
FIG. 5 illustrates a replaceable cartridge including the OX66™ material.

One simple answer to that problem is to use a replaceable cartridge including the OX66™ material like the one shown at 50 in FIG. 5.

It is understood in the art that higher temperatures are useful for performance of particularly diesel engines. The elevated NOx amounts that result from such elevated temperatures, however, have forced operators to reduce temperatures where possible to meet environmental limits. It is known that other methods such as ammonia or amine extraction methods are not possible at elevated temperatures. Advantageously, the OX66™ clathrate is stable and absorbs and holds NOx gases from −25 degrees C. to well over the operational upper limits of the offending engines.

Process methods include cartridge type devices that hold the poly-oxygenated metal clathrate but by design allow the gasses to pass through, collect the nitrogen and not pass out of operational volumes by leakage.

One embodiment includes a cloud chamber where the effluent and the elathrate react, and then the residual gas can pass through a membrane type filter to allow the clathrate to be captured and reused to saturation. The saturation point will affect the designs. A cartridge design is one easy way to do the job. At some point the cartridge will saturate with N and ease of removal is a design need.

When a cartridge becomes saturated the retained N material can be used as a substantially important fertilizer that will supply much needed nitrogen to crops, but it will not be in an explosive state like various nitrates. Further, the cartridge is light and easy to disperse, handle, and use.

Figure 6:
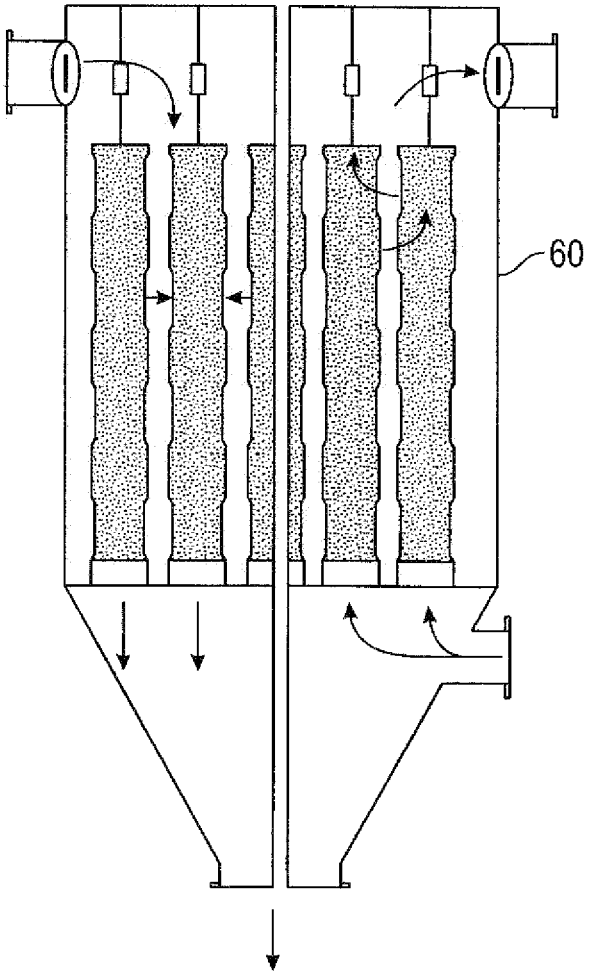
FIG. 6 illustrates collecting and perhaps bagging effluent residuals and a cone bottomed unit.

In the case of OX66™, the nitrogen enriched clathrate may have dynamic use. Collecting and perhaps bagging the effluent residuals and a cone bottomed unit as shown at 60 in FIG. 6 allows the collection and bagging for residual and other uses.

One of the deliveries of the filtered nitrogen rich oxygen powder can be air drops and dropped into cumulus clouds where "seeding" occurs and the resulting rain would not become acid rain since the oxygen of the clathrate will hold it in a stable rain drop solution.

Adding nano sized poly-oxygenated metal hydroxide particles into a fuel stream of an engine is another use.

Figure 7:
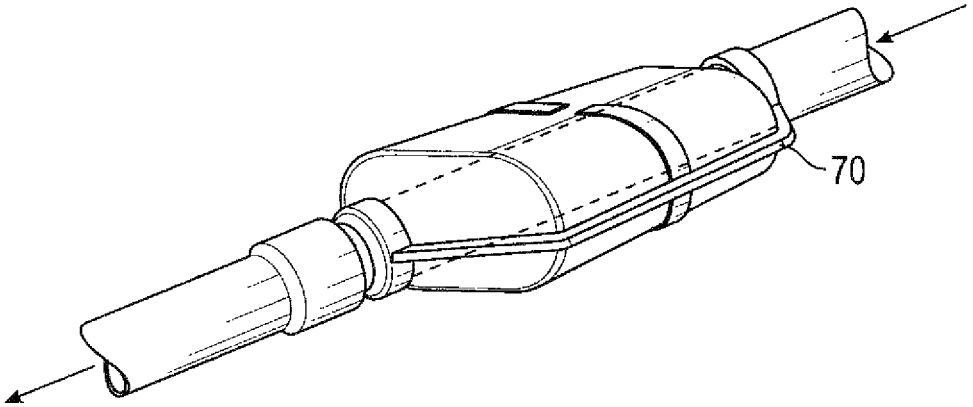
FIG. 7 illustrates adding the OX66™ material in the re-injection stream post the catalytic converter.

Adding the same material in the re-injection stream post the catalytic converter is another method, as shown at 70 in FIG. 7.

If the target is simply the exhaust at the manifold level, allowances need to be made for the engineering for back pressure considerations on the engine itself.

Nano sized poly-oxygenated metal hydroxide particles can have uses in deep diving breathing and survival apparatus to prevent niftogenation of the blood (the bends).

Other substantial uses include uses in long term space flights. It has the appeal of being very light and weight is always a consideration in space liftoffs/weight limitations. (NASA currently uses $10,000 per pound for payload lifting costs to Earth orbit.)

The second most common element in the universe Helium. The clathrate may hold substantial amounts of helium that is a natural byproduct from natural gas conibustion. As the electrical power industry converts more and more to methane use the potential for a novel helium scrubber/capture mechanism is possible and the method to extract the helium might just be thermal. The release of the gases from the clathrate may all be thermally controllable.

The OX66™ material may also be used as a leavening agent to aid in the production of unleavened breads. The material can scavenge the oxygen from the batter or during the cooking or pre-cooking stages, resulting in a dynamic step toward My unleavened breads that are highly sought and valued.

A mechanical use for particularly a nano-sized OX66™ material is as a super polishing agent for rayon and even silk cloth. This solves the current problem in using low level lasers to do the job and the super-smooth base material has a future in biological computers that will not be silicon based or will need a reliable biological inner-face with a silicon surface. Now thinking for advancing "Moore's Law" for transistors is being directed toward quantum-based units that have biological infrastructures.

Using the nano particle base OX66™ material has multiple uses. One use is as a mechanical abrasive to polish the surface and not risk burn or hot spots due to the use of vapor or laser honing. Another use is as a non-conductive insulator between organic layers to produce N-P orbital structures for photo voltaic and even thermal voltaic substrates.

The foregoing disclosure has been set forth merely to illustrate the disclosure and is not intended to be limiting. It will be appreciated that modifications, variations and additional embodiments are covered by the above teachings and within the purview of the appended claims without departing from the spirit and intended scope of the disclosure. Since modifications of the disclosed embodiments incorporating the spirit and substance of the disclosure may occur to persons skilled in the art, the disclosure should be construed to include everything within the scope of the appended claims and equivalents thereof.

I claim:

1. A composition, comprising:

a fuel; and a poly-oxygenated aluminum hydroxide material comprising a clathrate containing oxygen gas molecules disposed in the fuel, wherein the poly-oxygenated aluminum material is chlorine free.

2. The composition as specified in claim 1, wherein the fuel is a fluid.

3. The composition as specified in claim 1, wherein the fuel is combustible.

4. The composition as specified in claim 3, wherein the fuel is combustible by an internal combustion engine.

5. The composition as specified in claim 1, wherein the fuel comprises a petroleum-based fuel.

6. The composition as specified in claim 1, wherein the poly-oxygenated aluminum hydroxide material is solubilized in the fuel.

7. The composition as specified in claim 1, wherein the poly-oxygenated aluminum hydroxide material has particle sizes each less than or equal to 200 microns.

8. The composition as specified in claim 1, wherein the ratio by volume of fuel to the poly-oxygenated aluminum hydroxide is at least 100:1.

9. The composition as specified in claim 1, wherein the ratio by volume of fuel to the poly-oxygenated aluminum hydroxide is at least 200:1.

10. A method, comprising:

combusting a composition comprising a fuel, and a poly-oxygenated aluminum hydroxide material comprising a clathrate containing oxygen gas molecules disposed in the fuel, wherein the poly-oxygenated aluminum hydroxide material is chlorine free.

11. The method as specified in claim 10, wherein the ratio by volume of fuel to the poly-oxygenated aluminum hydroxide is at least 100:1.

12. The method as specified in claim 10, wherein the ratio by volume of fuel to the poly-oxygenated aluminum hydroxide is at least 200:1.

13. The method as specified in claim 10, wherein the fuel is a fluid.

14. The method as specified in claim 10, wherein the fuel comprises a petroleum-based fuel.

15. The method as specified in claim 10, wherein the poly-oxygenated aluminum hydroxide material is solubilized in the fuel.

16. The method as specified in claim 10, Wherein the poly-oxygenated aluminum hydroxide material has particle sizes each less than or equal to 200 microns.

* * * * *